US009180507B2

(12) United States Patent
Yabuta et al.

(10) Patent No.: US 9,180,507 B2
(45) Date of Patent: Nov. 10, 2015

(54) TURK'S HEAD STAND

(75) Inventors: Hiroaki Yabuta, Osaka (JP); Takeshi Watanabe, Osaka (JP); Tomoyasu Nakano, Osaka (JP)

(73) Assignee: Nakata Manufacturing Co., Ltd., Osaka (JP)

( * ) Notice: Subject to any disclaimer, the term of this patent is extended or adjusted under 35 U.S.C. 154(b) by 659 days.

(21) Appl. No.: 13/519,184

(22) PCT Filed: Dec. 28, 2009

(86) PCT No.: PCT/JP2009/071805

§ 371 (c)(1),
(2), (4) Date: Jun. 26, 2012

(87) PCT Pub. No.: WO2011/080837

PCT Pub. Date: Jul. 7, 2011

(65) Prior Publication Data

US 2012/0279270 A1 Nov. 8, 2012

(51) Int. Cl.
*B21C 37/08* (2006.01)
*B21D 3/05* (2006.01)

(52) U.S. Cl.
CPC .. *B21C 37/08* (2013.01); *B21D 3/05* (2013.01)

(58) Field of Classification Search
CPC ..... B21C 37/08; B21B 31/08; B21B 31/10; B21B 31/103; B21B 31/106; B21B 31/12; B21B 31/16; B21B 31/20; B21B 31/22; B21B 31/24; B21B 13/08; B21B 13/10; B21B 13/103; B21B 2031/021; B21B 2031/023; B21B 2031/025; B21B 2031/026; B21B 31/00; B21B 31/02; B21D 1/05; B21D 5/12; B21D 3/02; B21D 3/05; B30B 3/005
USPC ..... 72/237, 238, 239, 247, 249, 224, 225
See application file for complete search history.

(56) References Cited

U.S. PATENT DOCUMENTS 4,557,130 A * 12/1985 Bond ..... 72/225
5,590,557 A * 1/1997 Keller et al. ..... 72/238
5,685,188 A * 11/1997 Rehag et al. ..... 72/239

FOREIGN PATENT DOCUMENTS

| | | |
|---|---|---|
| CN | 2579544 | 10/2003 |
| CN | 2734365 | 10/2005 |
| CN | 101067470 | 11/2007 |
| JP | 63-025211 | 2/1988 |
| JP | 6-034810 | 5/1994 |
| JP | 08103816 A * | 4/1996 |

(Continued)

*Primary Examiner* — Shelley Self
*Assistant Examiner* — Gregory Swiatocha
(74) *Attorney, Agent, or Firm* — Hamre, Schumann, Mueller & Larson P.C.

(57) ABSTRACT

In a Turk's head stand, double inner frames are disposed inside an outer frame. A first inner frame is disposed so as to be adjusted in the vertical direction, and a second inner frame is disposed so as to be adjusted in the horizontal direction. Four-way straightening rolls and position adjusting devices are incorporated inside the second inner frame. Mechanical structures for convexo-concave engagement are disposed on faces of the respective roll chocks and yokes and the inner frames opposed to each other, thereby to guide the respective roll chocks and yokes, by utilizing descending motions of the inner frames, after connection with a pressing device has been released, to form the stack body in series, and to enable the stack body to be withdrawn from the roll stand.

4 Claims, 8 Drawing Sheets

(56) References Cited

FOREIGN PATENT DOCUMENTS

| | | | | | |
|---|---|---|---|---|---|
| JP | 10-235432 | 9/1998 | JP | 10235432 A | * 9/1998 |
| | | | JP | 3044247 | 5/2000 |
| | | | JP | 3128184 | 1/2001 |
| | | | JP | 3609940 | 1/2005 |

* cited by examiner

TURK'S HEAD STAND

TECHNICAL FIELD

The present invention is related to an improvement of a Turk's head stand for adjusting positions of whole four-way straightening rolls in both vertical and horizontal directions, in a state where the four-way straightening rolls are mounted at predetermined positions. Further, the present invention is related to the Turk's head stand which is so constructed that in exchanging the straightening rolls, instead of a conventional method in which whole face plates (housing) to which the rolls are mounted are exchanged, only roll chocks and roll yokes for pivotally supporting upper and lower horizontal rolls and right and left side rolls are stacked thereby to form a stack body of the roll chocks and yokes, and the stack body is withdrawn in a horizontal direction perpendicular to a product proceeding direction to be exchanged with another stack body which has been separately prepared.

BACKGROUND ART

In an electric resistance welded pipe producing process for producing a round pipe from a metal coil or strip material having a desired length, there are a preliminary step for uncoiling the metal coil to supply it to a forming step, an initial forming step to be executed by breakdown rolls, cluster rolls, and fin pass rolls, a welding step for welding edge portions of the strip material opposed to each other with high frequency for example, a finishing step for correcting roundness and straightness of the pipe by straightening rolls, and a cutting step for cutting a produced metal pipe into a predetermined length.

In the finishing step described above, an element pipe which has been welded into the round pipe is reduced in diameter to have a desired outer diameter by a sizing stand, and thereafter, a deflection or bend is straightened by a Turk's head stand thereby to obtain a straight electric resistance welded pipe. On the other hand, in case of producing a rectangular pipe from the round pipe which has been thus obtained, after a forming step for gradually flattening respective four arcs of a circumference is executed in a four-way rolls stand having a plurality of stages, finally, in a shaping step, such a Turk's head stand as disclosed in Patent Document 1 (FIG. 1) and Patent Document 2 (FIG. 6) is used to obtain the rectangular pipe.

As a representative structure, the Turk's head stand is so constructed that jacks are mounted on four corners of a housing (face plate) in a shape of a rectangular plate having a round hole in its center part, for example, and straightening rolls are disposed in an outer peripheral part of the round hole so that positional adjustment can be made with respect to the center of the housing by means of the jacks. This housing is supported in a cantilever manner at one side of a stand which is erected, and a position of the housing itself can be adjusted in a vertical direction by the jacks which are provided on the stand. Further, a position of the stands can be adjusted in a horizontal direction thereby to adjust the position of the housing in the horizontal direction.

PRIOR ART DOCUMENT

Patent Document

Patent Document 1: Japanese Utility Model Publication No. JP-A-63-25211

Patent Document 2: Japanese Utility Model Publication No. JP-A-06-34810

Patent Document 3: Japanese Patent No. 3128184

SUMMARY OF INVENTION

Technical Problem

Conventionally, exchange of the straightening rolls in the Turk's head stand is executed by hanging the housing (face plate) using a crane, in a state where the rolls and jacks are kept mounted on the housing. Specifically, a method in which: the straightening rolls to be exchanged are mounted on another housing which has been separately prepared beforehand; the housing which is mounted on the stand is taken out by hanging it with the crane; and then, the housing prepared beforehand is brought in by hanging it with the crane and is exchanged, is adopted.

In a case where the crane cannot be used directly above the Turk's head stand, as described above, a method as disclosed in Patent Document 3 has been adopted. Specifically, in this method, a rail for exchange is prepared beforehand in the horizontal direction perpendicular to a pipe moving direction in the production line. Then, the housing (face plate), that is, the face plate on which the jacks and rolls are mounted is once withdrawn in the horizontal direction and hung by the crane at outside of the line, thereby to be exchanged with a newly prepared face plate.

Specifically describing, a plate-shaped frame is disposed on a rectangular-shaped stand so as to move in both the vertical and horizontal directions, and the face plate on which the rolls and jacks are mounted is mounted on a face of the frame at an upstream side of the line interposing a detaching device. By constructing in this manner, it is possible to detach and transfer the face plate to a moving carriage which has entered onto the rail for exchange at the line side in front of the plate-shaped frame, and to receive the new face plate.

However, the housing (face plate) to be prepared beforehand in the off-line is supported in a cantilever manner at the upstream side of the line of the stand, and provided with all the devices to be operated on the line, such as the jacks as described above. Therefore, the housing tends to be extremely large-sized and heavy-weighted, and it is necessary to secure cost for preparing the devices and places for storing a plurality of the housings. Further, the crane for detaching and mounting the housings, a withdrawing device, a position sensor for the face plate enabling the housings to be detached and mounted, a locking device at the stand side, and so on are necessity.

An object of this invention is to provide a novel Turk's head stand which has such a structure that an inner frame which is not of cantilever type in a horizontal direction perpendicular to a direction of a production line is exchanged as a whole, instead of a conventional structure such that a face plate of cantilever type is exchanged as a whole, thereby the exchange of straightening rolls in the Turk's head stand is facilitated.

Another object of this invention is to provide a Turk's head stand which has such a structure that, in exchanging the straightening rolls, only a stack body of roll chocks and yokes which is detached from the frame is exchanged, instead of the structure such that the face plate of cantilever type is exchanged as a whole. Specifically, the roll chocks and yokes for pivotally supporting upper and lower rolls and right and left rolls are disconnected from a pressing device such as a jack, and stacked to form the stack body of the roll chocks and yokes. Then, this stack body is withdrawn in the horizontal direction perpendicular to a pipe moving direction in the production line so that the stack body can be exchanged with another stack body to be exchanged which has been prepared beforehand in an offline.

Solution to Problem

As an essential structure for the Turk's head stand in which a position of the whole four-way straightening rolls can be individually adjusted in both the vertical and horizontal directions, the inventors have considered such a structure that double inner frames are disposed inside an outer frame, wherein one of the inner frames is arranged so as to be adjusted only in the vertical direction, and the other is arranged so as to be adjusted only in the horizontal direction, and find that the inner frame can be exchanged by a configuration in which the four-way straightening rolls and position adjusting devices are incorporated between a pair of plate-shaped frames and in which the inner frame itself can be withdrawn in the horizontal direction.

Further, the inventors have focused to utilize ascending and descending motions of the inner frames to form and disassemble the stack body, in the structure where the double inner frames are disposed inside the outer frame, and have earnestly studied on a mechanical structure for utilizing the ascending and descending motions of the inner frames to form and disassemble the stack body of the roll chocks and yokes.

As a result, the inventors find that it is possible to omit actuators for moving and fixing the roll chocks and yokes in forming or disassembling the stack body and particularly to automatically connect or disconnect the side roll yokes to the pressing device by a configuration such that: a mechanical structure of convexo-concave engagement between convex ribs and grooves which are formed by strip members on desired opposing faces of the roll chocks and yokes and the inner frames opposed to each other is disposed; the respective roll chocks and yokes are guided by the mechanical structure utilizing the down motions of the inner frames after connection with the jacks, for example, has been released, thereby to form the stack body in series so that the stack body is withdrawn from the roll stand; and, utilizing the ascending motions of the inner frames, the stack body of the roll chocks and yokes can be disassembled, and the respective roll chocks and yokes can be guided to desired positions inside the stand, and then, connected to the jacks. Thereby, the roll chocks and yokes can be easily arranged and fixed in this manner. This invention has been thus completed by the inventors.

Specifically, there is provided according to the invention, a Turk's head stand comprising: a first inner frame, including a pair of plates, and incorporated in an outer frame so as to move only in a vertical direction; a second inner frame, including a pair of plates, and incorporated in the first inner frame so as to move only in a horizontal direction; upper and lower roll chocks and right and left side roll yokes, locked in the second inner frame so as to be separated from each other by a mechanical structure; position adjusting devices, connected to the respective roll chocks and yokes locked in the second inner frame for moving the upper and lower roll chocks and right and left side roll yokes close to or apart from each other, the position adjusting devices being installed between ends of the second inner frame; and a transfer rail, provided in a lower part of the outer frame in a horizontal direction perpendicular to a product proceeding direction, wherein the whole second inner frame is configured to be transferred in the horizontal direction from an inside of the first inner frame to the transfer rail.

Moreover, there is provided according to the invention, the Turk's head stand comprising: a first inner frame, including a pair of plates, and incorporated in an outer frame so as to move only in a vertical direction; a second inner frame, including a pair of plates, and incorporated in the first inner frame so as to move only in a horizontal direction; upper and lower roll chocks and right and left side roll yokes, locked in the second inner frame so as to be separated from each other by a mechanical structure, position adjusting devices, connected to the respective roll chocks and yokes locked in the second inner frame for moving the upper and lower roll chocks and right and left side roll yokes close to or apart from each other, the position adjusting devices being installed between ends of the second inner frame, one of the position adjusting devices which are installed on a horizontal end being disposed in the second inner frame so as to move in the vertical direction; and a transfer rail, provided in a lower part inside the outer frame in a horizontal direction perpendicular to a product proceeding direction, wherein the respective roll chocks and yokes are locked to desired positions inside the second inner frame by the mechanical structure when the first inner frame ascends, and wherein the lock is released when the first inner frame descends, so that a stack body of the roll chocks and yokes is formed on the transfer rail, by mounting the right and left side roll yokes on the lower horizontal roll chock, and further mounting the upper horizontal roll chock on the right and left side roll yokes, thereby enabling the stack body to be withdrawn in a direction toward the transfer rail.

Advantageous Effects of Invention

According to the invention, the first inner frame including a pair of the plates is incorporated in the outer frame so as to move only in the vertical direction, and the second inner frame including a pair of the plates is incorporated in the first inner frame so as to move only in the horizontal direction, thereby, positions of the whole four-way straightening rolls which are disposed in the second inner frame can be adjusted at the same time in the vertical or horizontal direction with respect to the production line, or in both the vertical and horizontal directions. The Turk's head stand according to the invention has essential functions, and has excellent operability.

In this invention, utilizing that the second inner frame is incorporated in the first inner frame so as to move only in the horizontal direction, the transfer rail is provided in the horizontal direction perpendicular to the product proceeding direction of the outer frame, and the whole second inner frame can be transferred in the horizontal direction from an interior of the first inner frame to the transfer rail to be exchanged with the newly prepared second inner frame. This second inner frame can be provided with high rigidity, by including a pair of the plates, and has such advantage that it can be made downsized and lightweight, as compared with the conventional face plate of cantilever type.

According to this invention, it is possible to withdraw the stack body of the roll chocks and yokes formed by stacking only the roll chocks and yokes for pivotally supporting the upper and lower horizontal rolls and the right and left side rolls which are locked in the second inner frame in the horizontal direction perpendicular to the production line, and to exchange it with the stack body of the roll chocks and yokes which has been separately prepared.

Therefore, according to this invention, as compared with the conventional stand where the whole face plates (housing) equipped with the roll chocks, roll yokes and jacks is to be exchanged, there is no necessity of disposing a crane on the stand in exchanging the straightening rolls, nor necessity of preparing and storing a plurality of the face plates. As a result, the cost for the devices and storage places need not be secured.

The stack body of the roll chocks and yokes is extremely compact and lightweight, as compared with the conventional face plates. Therefore, it is easy to disassemble or form the stack body, and to execute exchange and maintenance of the rolls in the offline. Therefore, the cost for the devices and storage places can be remarkably reduced.

According to this invention, the stack body of the roll chocks and yokes is formed when the first inner frame descends, that is, when the second inner frame incorporated in the first inner frame moves downward from an operative position to an exchanging position. The stack body thus formed can be transferred, when the second inner frame which incorporates and locks the rolls is in the exchanging position. When the second inner frame ascends again to the operative position, the stack body can be disassembled, and the side roll yokes can be guided and locked to the desired positions. These actions are realized by the mechanical structures including the convex ribs and groove members which are provided on the opposing faces of the frame and the roll chocks and yokes opposed to each other. As the results, it is possible to form or disassemble the stack body only by the lift device of the first inner frame, and so, exclusive actuators and a driving source are not required.

According to the invention, forming loads of the side roll yokes are born only by the second inner frame, and forming loads of the upper and lower roll chocks are born by the first inner frame. In short, it is possible to disperse the loads to the outer frame and the inner frames, and structurally rational design can be made.

DESCRIPTION OF EMBODIMENTS

Figure 1:
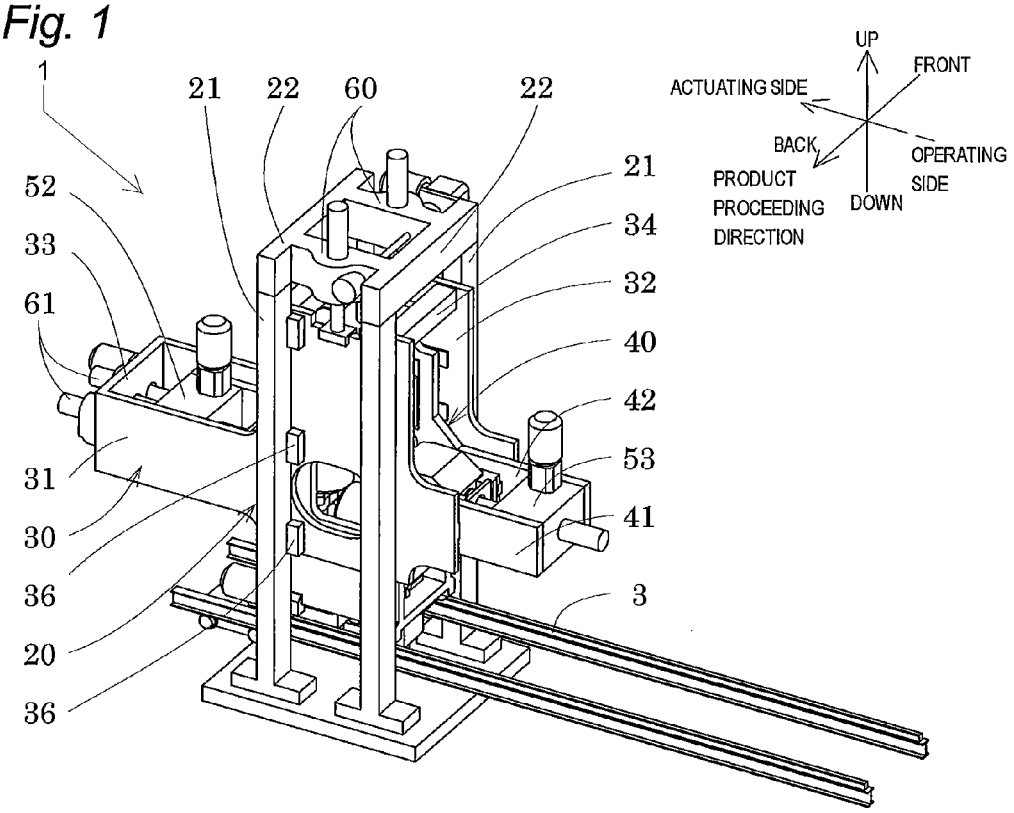
FIG. 1 is an explanatory perspective view showing an example of Turk's head stand having four-way rolls equipped in the stand and in an online state where the Turk's head stand is operable, as seen from the back in a product proceeding direction.

An essential function as the Turk's head stand is to allow four-way straightening rolls which can be individually adjusted in position with respect to a pipe to be straightened, to be adjusted in position in the vertical and horizontal directions or both in the vertical and horizontal directions in package and at the same time. In the present invention, the essential function is realized by incorporating upper and lower horizontal roll chocks and right and left side roll yokes in a second inner frame, by incorporating position adjusting devices which are connected to the respective roll chocks and yokes for moving upper and lower horizontal rolls and right and left side rolls close to or apart from each other, by incorporating this second inner frame in a first inner frame so as to move only in a horizontal direction, and further, by incorporating the first inner frame in an outer frame so as to move only in a vertical direction.

As the outer frame, either of known structures such as a gate-shaped structure formed of columnar members as employed in the embodiments, a rectangular frame, a combination of the gate-shape and face plate type, and so on may be adopted. The inner frames are not particularly limited, except that they are formed of a pair of plate-like members, but can be appropriately selected out of cross-shaped plate members as employed in the embodiments, face plates in a rectangular shape or octagonal shape. Further, cutouts or relief holes for weight reduction may be formed at predetermined positions of the face plates.

A method of mounting the roll chocks and yokes for forming the stack body is appropriately selected out of abutting contact between faces, engagement between pins and holes or between rods and grooves, face contact, and a combination of various mechanical structures, etc., according to shapes, sizes, and weights of the roll chocks at upper and lower sides and at both sides, for example. Moreover, for connecting the respective roll chocks and yokes to the position adjusting devices, either of known structures can be adopted.

As a lift device for actuating the first inner frame which is incorporated in the outer frame so as to move up and down, a hydraulic actuator or other known jacks of various types can be adopted, and the lift device can be mounted on the outer frame. Moreover, as the horizontally actuating device for actuating the second inner frame which is incorporated in the first inner frame so as to move in the horizontal direction, a hydraulic actuator or other known jacks of various types can be adopted, and can be mounted on the first inner frame. Further, as the position adjusting device which is connected to the upper and lower horizontal roll chocks and the right and left side roll yokes for moving the horizontal rolls and the side rolls close to or apart from each other, a hydraulic actuator or other known jacks of various types can be adopted, and can be mounted on the second inner frame.

As the mechanical structures which are provided on the opposed faces of the roll chocks and yokes and the inner frames opposed to each other, an example of forming convex parts and grooves using convex strip members thereby to perform convexo-concave engagement is adopted in the embodiments. However, it is possible to adopt either of the known structures besides the example in the embodiments, provided that the following functions are satisfied.

Specifically, in the stack body of the roll chocks and yokes, a pair of the side roll yokes are mounted on an upper face of the lower roll chock, and the upper roll chock is mounted on the side roll yokes so as to override upper faces thereof. Moreover, as the four-way rolls, the upper and lower roll chocks are adjusted in position in the vertical direction, and the side roll yokes are adjusted in position in the horizontal direction, inside the inner frames. For this reason, the upper and lower roll chocks are movable in the vertical direction, but locked so as to be positioned in the horizontal direction, and the side roll yokes are movable in the horizontal direction, but locked so as to be positioned in the vertical direction. Therefore, a function of guiding the roll chocks and yokes so as to be locked at positions of desired heights with ascending and descending motions of the inner frames is required. Basically, it is necessary to support the roll chocks and yokes by the convex strip members and pin members, or to guide the roll chocks and yokes through desired grooves.

Embodiment 1

FIG. 1 is an explanatory perspective view showing an example of the Turk's head stand. As shown in the drawing, a direction from this side to a deep side in the drawing is called as a product proceeding direction. The deep side in the drawing is an inlet side of raw material, and this side in the drawing is an outlet side of the raw material. As seen from the stand, the inlet side of the raw material is called as a front side, while the outlet side of the raw material is called as a back side. Moreover, a left side in a lateral direction of the drawing is called as an actuating side, while a right side in the lateral direction is called as an operating side.

A Turk's head stand 1 includes an outer frame 20 in a gate-like shape, a first inner frame 30 composed of a pair of face plates 31, 32 which are disposed inside the outer frame 20, and a second inner frame 40 composed of a pair of face plates 41, 42 which are further disposed inside the first inner frame 30.

The outer frame 20 is so constructed that two columnar members 21 are uprightly provided on a base board, and formed in a shape of a gate by connecting upper parts thereof by means of a beam member 22. Two sets of the gate-shaped columnar members 21 are arranged in parallel at a predetermined interval at both sides of the product proceeding direction, and the beam members 22 at the top are connected together by means of a gear box of a lift device 60. The outer frame 20 is constructed in such a manner that the upper parts of the four columnar members 21 are connected together by means of a frame in a ladder shape.

The first inner frame 30 is formed by abutting a pair of cross-shaped face plates 31, 32 against the columnar members 21 of the outer frame 20 in the horizontal direction perpendicular to the product proceeding direction so that their flat plate parts may be opposed to each other at a predetermined interval. Moreover, a pair of the face plates 31, 32 of the first inner frame 30 are integrally formed by connecting their upper parts by means of a connecting plate 33, and by connecting their horizontally actuating sides by means of a connecting member 34. Further, an upper part of the first inner frame 30 is connected to a jack shaft of the lift device 60 which is provided on the beam members 22 in a direction perpendicular to the product proceeding direction so that the first inner frame 30 can move up and down in sliding contact with the columnar members 21.

Figure 4:
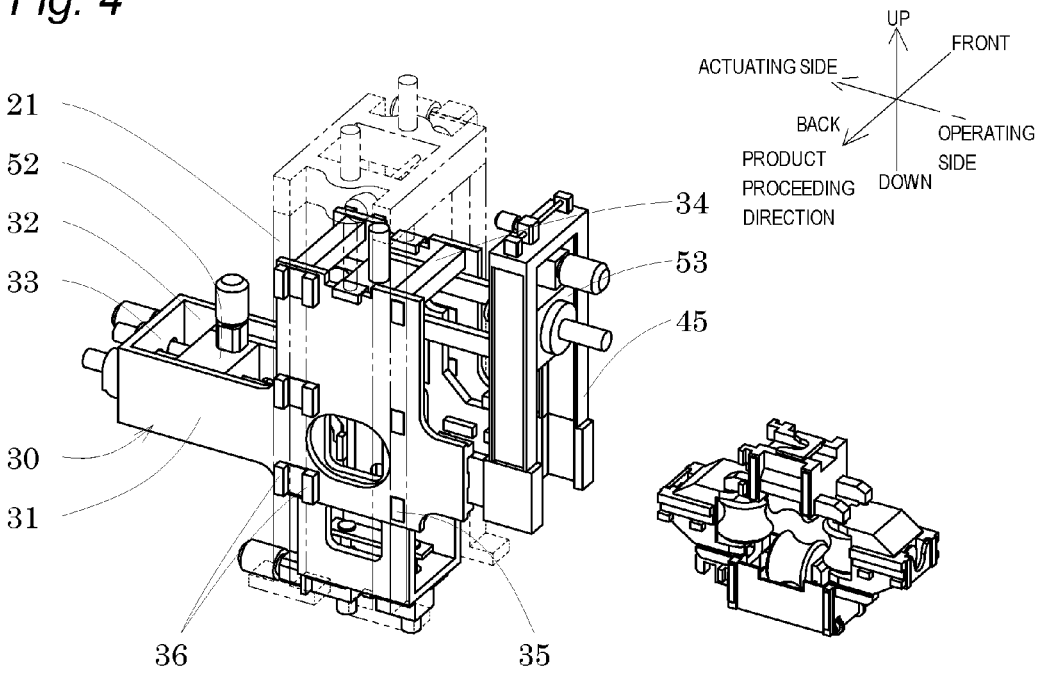
FIG. 4 is an explanatory perspective view showing mechanical structures of an outer frame and inner frames in FIG. 3, omitting a transfer rail, particularly showing an engaged part between the outer frame which is shown by imaginary lines and a first inner frame.

A sliding part will be described referring to FIG. 4 showing Embodiment 2 which has a substantially same structure. Slider plates 35 are pasted to those parts of the face plate 31 to be brought into contact with the columnar members 21, and three pairs of guide members 36 which are formed of short rods are provided on an outer face of the face plate 31 so as to clamp the columnar members 21, so that the first inner frame 30 can move up and down only in the vertical direction in sliding contact with the columnar members 21.

Figure 5:
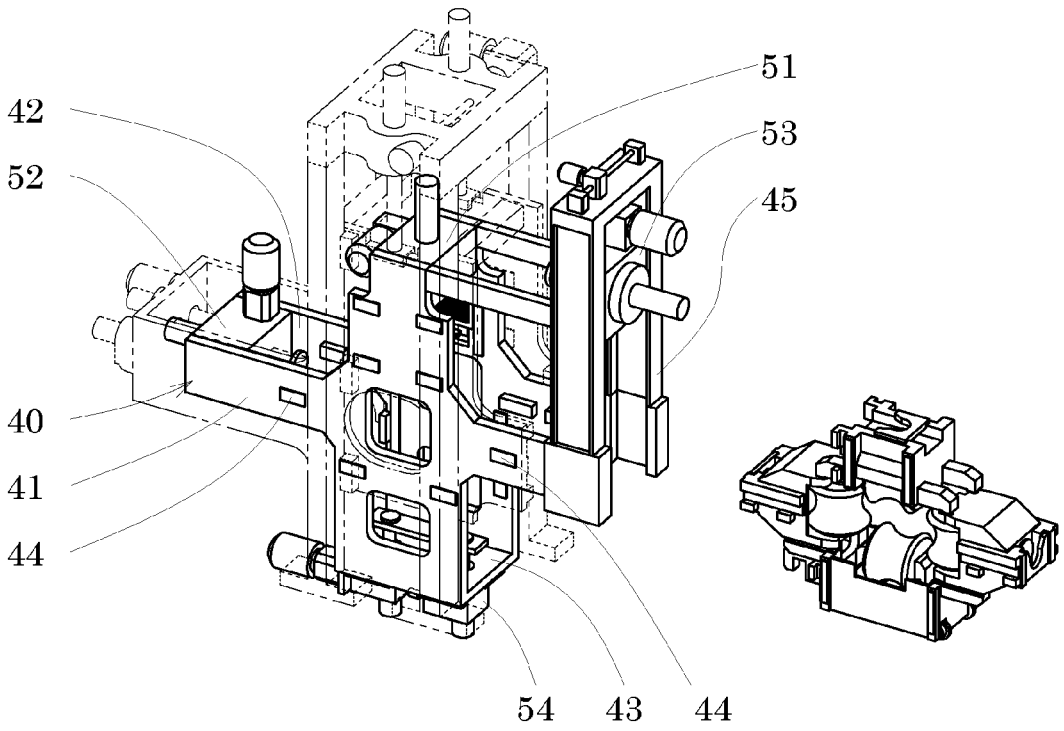
FIG. 5 is an explanatory perspective view showing the mechanical structures of the outer frame and the inner frames in FIG. 3, omitting the transfer rail, in which the outer frame and the first inner frame are shown by imaginary lines, and particularly, showing an engaged part between the first inner frame and the second inner frame.

The second inner frame 40 is incorporated in the first inner frame 30 so as to move only in the horizontal direction. In the same manner, a pair of the cross-shaped face plates 41, 42 are abutted against the face plates 31, 32 of the first inner frame 30 by way of slider plates 44 (See FIG. 5) which are appropriately pasted, and the face plates 41, 42 are arranged in such a manner that inner flat parts thereof are opposed to each other at a predetermined interval.

Moreover, a pair of the face plates 41, 42 of the second inner frame 40 are integrally formed by connecting their lower parts by means of a connecting plate 43, and by respectively connecting their upper parts, horizontally actuating sides, and operating sides by means of gear boxes of position adjusting devices 51, 52, 53 including jacks. Further, the gear box of the position adjusting device 51 positioned at the horizontally actuating side is connected to a jack shaft of a horizontally actuating device 61 which is provided on the connecting plate 33 of the first inner frame 30, so as to horizontally move in sliding contact with the face plates 31, 32. Further, a position adjusting device 54 including a jack is suspended from the connecting plate 43 in the lower parts of the face plates 41, 42.

Upper and lower horizontal roll chocks 5, 6 and right and left side roll yokes 7, 8 are incorporated in the second inner frame 40, and the rolls can be moved close to or apart from the product proceeding line by means of the position adjusting devices 51 to 54.

As described above, the first inner frame 30 can be adjusted in position by the lift device 60 in the vertical direction inside the outer frame 20, and the second inner frame 40 which is incorporated in the first inner frame 30 can be adjusted in position by the horizontally actuating device 61 in the horizontal direction.

Therefore, in the second inner frame 40 incorporating the four-way rolls so as to be individually adjusted in position, the whole face plates can be adjusted in position in both the vertical and horizontal directions with respect the product proceeding line. In this manner, it becomes possible to straighten a bend or so of the product.

On the other hand, the second inner frame 40 incorporating the four-way rolls can be withdrawn to the operating side at the right side in the drawing, by releasing the connection with the jack shaft of the horizontally actuating device 61 which is provided on the connecting plate 33 of the first inner frame 30.

Specifically, as shown in FIG. 1, a transfer rail 3 is provided on the base board of the outer frame 20 in a direction perpendicular to the product proceeding line, and wheels are provided on the connecting plate 43 in the lower part of the second inner frame 40, so that the wheels can roll on the transfer rail 3. Then, the second inner frame 40 incorporating the four-way rolls can be withdrawn from the first inner frame 30 thereby to exchange the rolls in the offline.

This second inner frame 40 includes a pair of the face plates 41, 42 in a plate-like shape, and the face plates 41, 42 are rendered to have high rigidity, by connecting their four ends, namely, upper, lower, right and left ends by means of the gear boxes of the position adjusting devices 51, 52, 53, and the connecting plate 43. Therefore, as compared with the conventional face plates of cantilever type, the second inner frame 40 can be advantageously made compact and lightweight.

Embodiment 2

The Turk's head stand in Embodiment 2 is so constructed that a first inner frame including a pair of plates is incorporated in an outer frame together with a lift device, so as to move only in a vertical direction, a second inner frame including a pair of plates is incorporated in the first inner frame together with a horizontally actuating device, so as to move only in a horizontal direction, upper and lower horizontal roll chocks and right and left side roll yokes are locked in the second inner frame, so as to be separated from each other by mechanical structures by engagement between strip members and groove members which are formed on the frame faces and the roll chocks and roll yokes opposed thereto, position adjusting devices which are connected to the respective roll chocks and yokes locked in the second inner frame for moving the upper and lower roll chocks and right and left side roll yokes close to or apart from each other are installed on vertical ends and horizontal ends in the second inner frame, one of the position adjusting devices which is installed on the horizontal end is disposed in the second inner frame so as to move in the vertical direction, the side roll yokes are locked to desired positions inside the second inner frame by the mechanical structures along with ascending motion of the first inner frame, and the lock can be released along with descending motion of the first inner frame. The structure will be described below.

Figure 2:
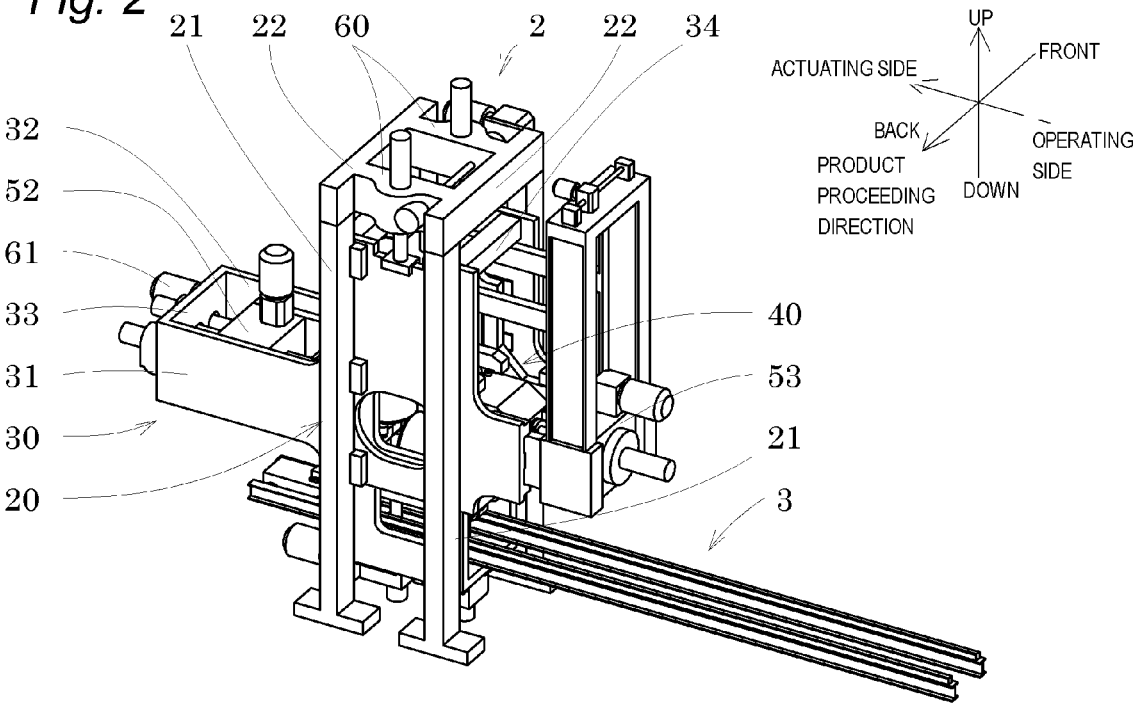
FIG. 2 is an explanatory perspective view showing another example of Turk's head stand having the four-way rolls equipped in the stand and in the online state where the Turk's head stand is operable, as seen from the back in the product proceeding direction.
Figure 3:
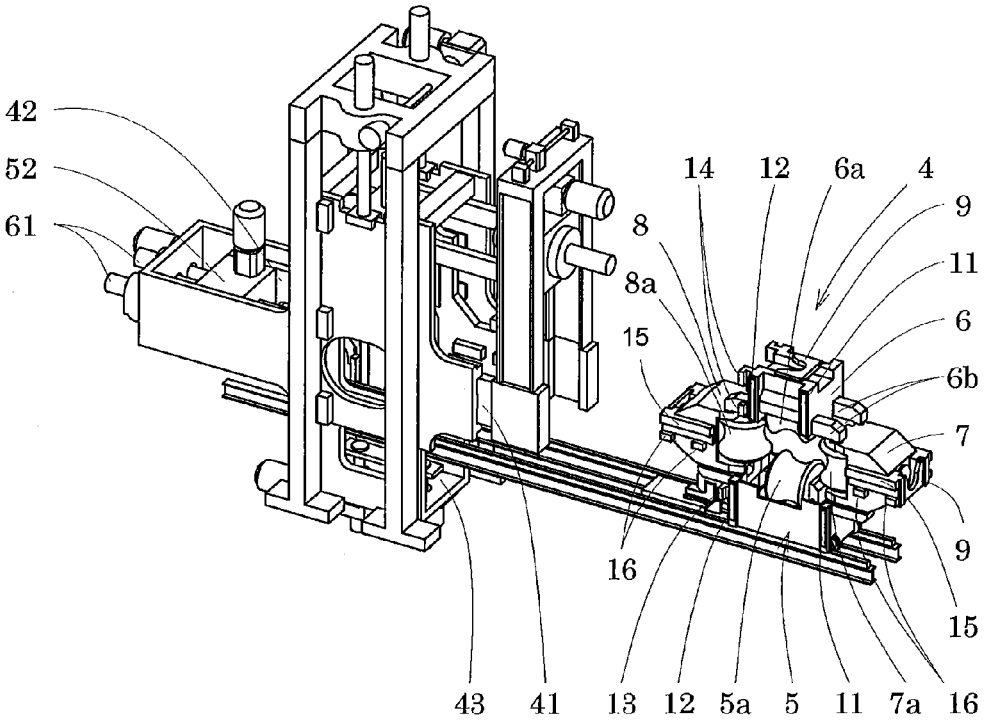
FIG. 3 is an explanatory perspective view showing the Turk's head stand in an offline state where a stack body of roll chocks and yokes is withdrawn from the Turk's head stand in FIG. 2, or in an offline state before the stack body is transferred into the stand, as seen from an outlet side in the product proceeding direction.

FIG. 2 is an explanatory perspective view showing an example of Turk's head stand 2 in an online state where the stand is operable, and FIG. 3 is an explanatory perspective view showing the Turk's head stand 2 in an offline state where the stack body 4 of the roll chocks and yokes has been transferred from the stand 2 to the operating side in a lateral direction of the drawing.

The stack body 4 which is placed on the transfer rail 3 as shown in FIG. 3 is formed by mounting the side roll yokes 7, 8 on the lower roll chock 5, and further mounting the upper roll chock 6 thereon.

The lower roll chock 5 is provided with the wheels for moving along the transfer rail 3. Two each of pins are uprightly provided on upper and lower faces of the side roll yokes 7, 8 at a predetermined interval in the product proceeding direction. The lower roll chock 5 is provided with four pin holes on an upper face thereof, and the upper roll chock 6 is provided with two leg portions 6*b* on respective side faces of a lower part thereof at the actuating side and the operating side. The leg portions 6*b* are respectively formed with pin holes into which the pins on the upper faces of the side roll yokes 7, 8 can be inserted. The pins on the upper and lower faces of the side roll yokes 7, 8 are inserted into the pin holes in the upper and lower roll chocks 6, 5 thereby to form the stack body 4.

In the same manner as in Embodiment 1, the Turk's head stand 2 includes the gate-shaped outer frame 20, the first inner frame 30 composed of a pair of the face plates 31, 32 which is incorporated in the outer frame 20 so as to move up and down in the vertical direction, and the second inner frame 40 composed of a pair of the face plates 41, 42 which is incorporated in the first inner frame 30 so as to slide only in the horizontal direction.

Basically, the outer frame 20 and the first inner frame 30 have the exactly same structure as in Embodiment 1. The second inner frame 40 has the exactly same structure as described in detail in Embodiment 1, except that the position adjusting device 53 at the operating side is so constructed as to move up and down, and the second inner frame 40 is provided with mechanical structures for enabling the stack body 4 of the roll chocks and yokes to be formed or disassembled along with the vertical movement of the first inner frame 30.

The second inner frame 40 has a gate-shaped lift frame 45 which is uprightly held at ends of the face plates 41, 42 at the operating side (See FIG. 6), and beam members 46 connecting the frame 45 to the position adjusting device 51 at the top end. Moreover, a jack 47 is provided so that the position adjusting device 53 can move up and down inside the frame 45.

Now, operation for disassembling the stack body 4 of the roll chocks and yokes and bringing it into an operable state, after the stack body 4 has been transferred along the transfer rail 3 and inserted into the Turk's head stand 2, as shown in FIG. 3, will be described in series, referring to FIGS. 6 to 8.

To begin with, the mechanical structures of the stack body 4 which are provided on the faces opposed to the inner faces of the face plates 41, 42 of the second inner frame 40 will be described referring to FIG. 3. In the drawing, a side to be engaged with the face plate 42 is shown. The lower roll chock 5 is provided with vertical strip members 11, 12 at both ends thereof, and a vertical strip member 13 formed of a short rod for forming a groove of a predetermined gap is disposed in parallel with the vertical strip member 12 at the actuating side. The upper roll chock 6 is provided with the vertical strip members 11, 12 at both ends thereof, and a pair of vertical strip members 14 each of which formed of a short rod for forming grooves of a predetermined gap are disposed at a predetermined interval in parallel with the vertical strip member 12 at the actuating side. The side roll yokes 7, 8 are provided with long and horizontal strip members 15, and a pair of horizontal strip members 16 each formed of a short rod for forming grooves of a predetermined gap between them are disposed at a predetermined interval in parallel with the horizontal strip members 15.

Figure 6:
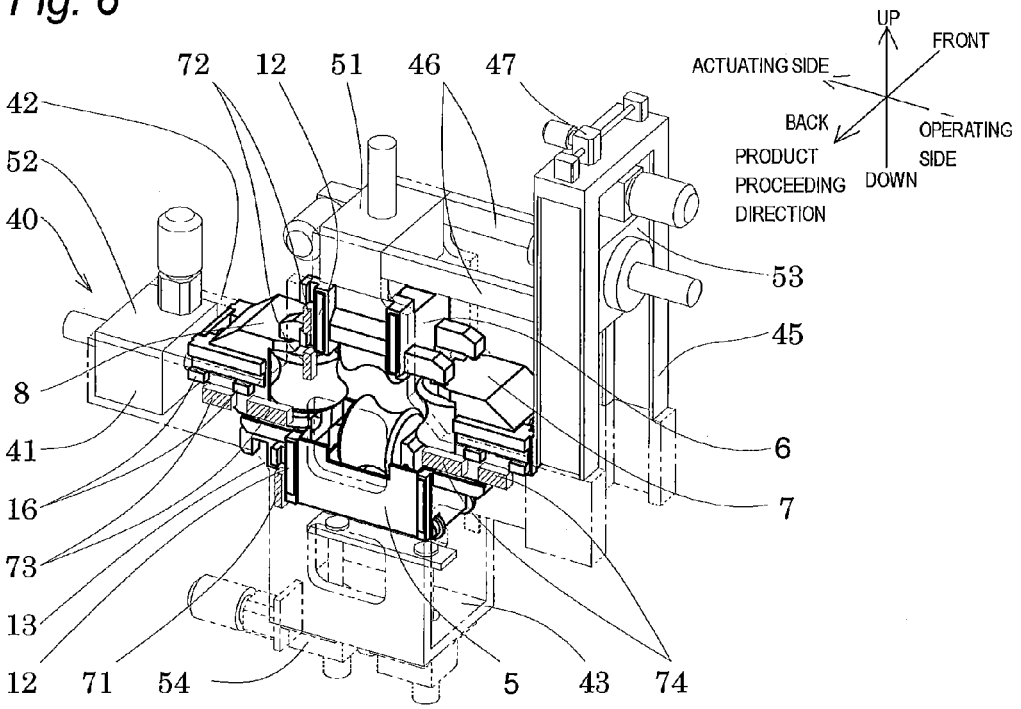
FIG. 6 is an explanatory perspective view showing positional relation between the respective mechanical structures which are provided on faces of the second inner frame and the stack body of the roll chocks and yokes opposed to each other at the outlet side of the product proceeding direction, and positional relation between the second inner frame and jacks for the side roll yokes, in a state where the stack body can be transferred into or from the second inner frame.

FIG. 6 is an explanatory perspective view showing positional relation between the mechanical structures which are provided on the faces of the face plate 42 and the stacked boy 4 opposed to each other at the outlet side in the product proceeding direction (backward side of the stand), when the stack body 4 is inserted between a pair of the face plates 41, 42 of the second inner frame 40 which has descended to the lowermost position. In the drawing, the members provided on the face plate 42 are hatched so as to distinguish them from the members on the stack body 4.

As a first step, the position adjusting device 53 at the operating side is elevated up to the uppermost position inside the lift frame 45, for the purpose of inserting the stack body 4 into the second inner frame 40.

In this embodiment, for the purpose of stopping the stack body 4 which has been inserted up to a predetermined vertical position, vertical strip members 71, 72 are provided on the face plate 42 at positions where the vertical strip members 12 of the lower roll chock 5 and the upper roll chock 6 at the actuating side are abutted against the face plate 42. The vertical strip member 13 to be mated with the vertical strip member 12 of the lower roll chock 5 is formed shorter to avoid interference with the vertical strip member 71 on the face plate 42. Moreover, a pair of the vertical strip members 14 for forming the grooves in cooperation with the vertical strip members 12 of the upper roll shock 6 are offset from a pair of the vertical strip members 72 on the face plate 42 to avoid interference between them, on occasion of the horizontal movement, and clearances are set so that they can pass each other.

The face plate 42 is further provided with horizontal strip members 73, 74 having a width capable of being inserted into the guide grooves between the horizontal members 15 and 16 of the side roll yokes 7, 8, and formed of a pair of short rods which are arranged at a predetermined interval in a line. When the stack body 4 is inserted, a pair of the horizontal strip members 16 of the side roll yokes 7, 8 are positioned above a pair of the horizontal strip members 73, 74 on the face plate 42, and offset from each other to avoid interference between them, on occasion of the vertical movement, and clearances are set so that they can pass each other.

Figure 7:
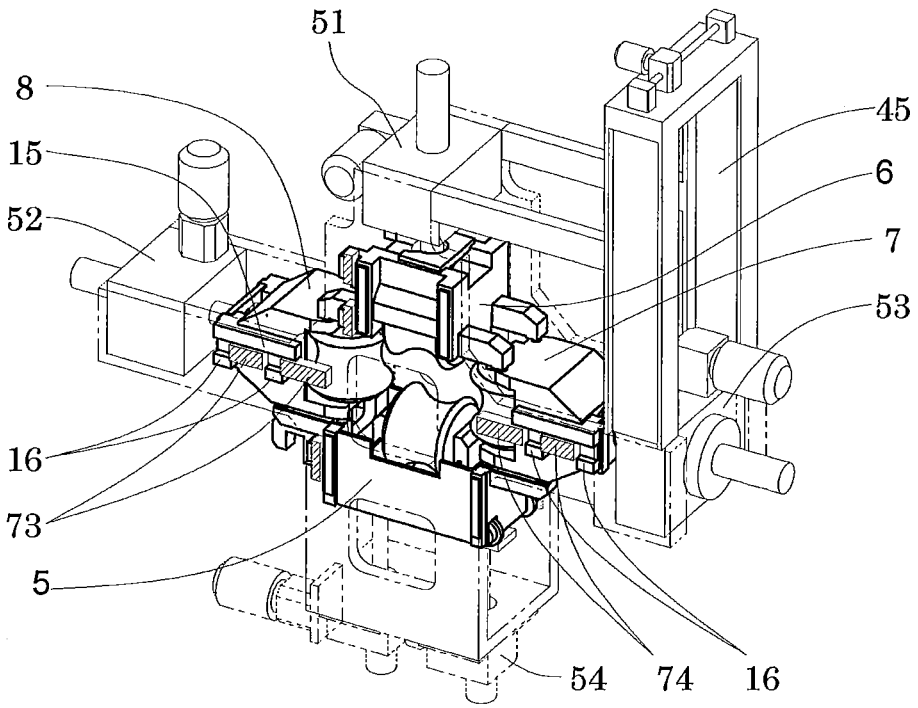
FIG. 7 is an explanatory perspective view showing positional relation between the respective mechanical structures which are provided on the faces of the second inner frame and the stack body of the roll chocks and yokes opposed to each other at the outlet side in the product proceeding direction, and positional relation between the second inner frame and the jacks for the side roll yokes, in a state where the second inner frame has ascended up to a fixed position.

FIG. 7 is an explanatory perspective view showing positional relation between the respective mechanical structures which are provided on the faces of the second inner frame and the roll chocks and yokes opposed to each other at the outlet side in the product proceeding direction, in a state where the second inner frame 40 which is incorporated in the first inner frame 30 and shown in the drawing has ascended from the lowermost position to a fixed position by lifting the first inner frame 30 by the lift device 60. In this state, the right and left side roll yokes 7, 8 are separated from the lower roll chock 5, and the position adjusting device 53 which has descended inside the lift frame 45 is connected to the side roll yoke 7.

When the second inner frame 40 has ascended, the vertical strip members 71, 72 on the face plate 42 ascend inside the grooves which are formed between the vertical strip members 12 and the vertical strip members 13, 14 of the lower and upper roll chocks 5, 6. Because the vertical strip members 71, 72 are aligned in the horizontal direction, positioning in the horizontal direction is performed.

When the second inner frame 40 ascends, a pair of the horizontal strip members 73, 74 on the face plate 42 pass through the horizontal strip members 16 of the side roll yokes 7, 8 to be abutted against the horizontal members 15. Although only the back side in the product proceeding direction has been described, it is apparent that the face plate 41 at the front side has the same structure. Because the side roll yokes 7, 8 themselves are elevated by the two face plates 41, 42, the pins of the right and left side roll yokes 7, 8 are withdrawn from the pin holes in the lower roll chock 5, thereby allowing the side roll yokes 7, 8 to move in the horizontal direction.

The upper roll chock 6 mounted on the side roll yokes 7, 8 which have ascended, as described above, comes into contact with the jack rod of the position adjusting device 51 at the top of the second inner frame 40. Therefore, the upper roll chock 6 can be automatically connected to the position adjusting device 51, by providing, for example, an engaging tool to be engaged with the connecting plate 9 at the top of the upper roll chock 6 in the drawing, at a distal end of the jack rod. At this time point, the pins on the upper faces of the side roll yokes 7, 8 are withdrawn from the pin holes in the leg portions 6*b* of the upper roll chock 6, thereby allowing the side roll yokes 7, 8 to move in the horizontal direction.

When the second inner frame 40 ascends, the connecting plates 9 which are provided at outer ends of the side roll yokes 7, 8 can be automatically connected to the position adjusting device 53 which has descended inside the lift frame 45 and the position adjusting device 52 at the actuating side, by means of the above described engaging tools provided on distal ends of the jack rods of the position adjusting devices 52, 53. Moreover, the jack rod of the position adjusting device 54 at the lower side is abutted against the lower face of the lower roll chock 5 thereby allowing the lower roll chock 5 to ascend or descend.

Figure 8:
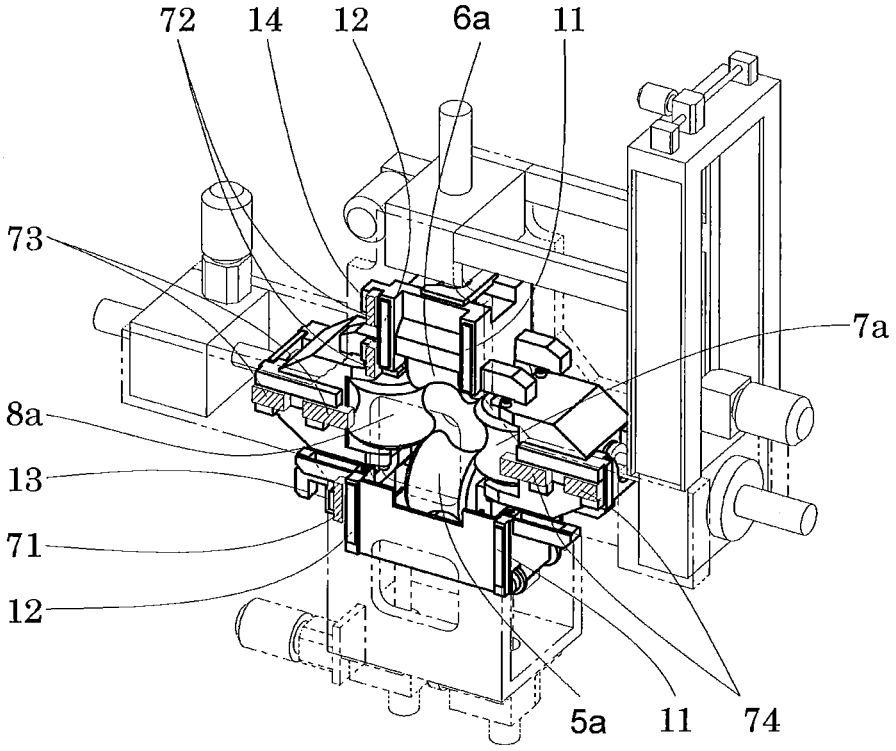
FIG. 8 is an explanatory perspective view showing positional relation between the respective mechanical structures which are provided on the faces of the second inner frame and the stack body of the roll chocks and yokes opposed to each other at the outlet side in the product proceeding direction, and positional relation between the second inner frame and the jacks for the side roll yokes, in an operable state.

FIG. 8 is an explanatory perspective view showing positional relation between the respective mechanical structures, in a state where desired positional adjustments have been completed, from a state where the stack body 4 is disassembled, with the ascending motion of the second inner frame 40 as shown in FIG. 7, to a state where upper and lower rolls 5*a*, 6*a* and right and left side rolls 7*a*, 8*a* are locked at predetermined positions inside the second inner frame 40.

When the right and left side rolls 7*a*, 8*a* are moved in a direction of separating from each other by the position adjusting devices 52, 53, a pair of the horizontal strip members 73, 74 on the face plate 42 are positioned in the grooves between the horizontal strip members 15, 16 of the side roll yokes 7, 8, and the horizontal strip members 73, 74 are aligned in the vertical direction thereby to perform the positional adjustment in the vertical direction. Basically, it is so set that the rolls may be brought into the operable state, by allowing the lower roll chock 5 to descend by the position adjusting device 54, and by allowing the upper roll chock 6 to ascend by the position adjusting device 51.

After the positional adjustments of the respective rolls as shown in FIG. 8 have been completed, the predetermined straightening operation becomes able to start. Specifically, by moving the first inner frame 30 up and down by the lift device 60 according to condition of the product, and by horizontally moving the second inner frame 40 by the horizontally actuating device 61, it is possible to shift the four-way straightening rolls to the desired positions in a direction perpendicular to the product proceeding line, and hence, it is possible to straighten a bend or so of the product.

In order to form the stack body 4, and to transfer the stack body 4 by placing it on the transfer rail 3, the operation steps as described in FIGS. 6, 7 and 8 have only to be executed in a reverse order. Specifically, in order to form the stack body 4 from the operative state in FIG. 8, the first inner frame 30 and the second inner frame 40 are returned to normal positions inside the outer frame 20, the lower roll chock 5 at the operative position is allowed to ascend inside the second inner frame 40, and the upper roll chock 6 is allowed to descend thereby to separate the side roll yokes 7, 8 from each other, into the state in FIG. 7 where the positioning in the vertical direction can be released. On this occasion, the pins provided on the upper and lower faces of the side roll yokes 7, 8 are respectively positioned directly above the pin holes of the lower roll chock 5 and directly below the pin holes in the leg portions 6*b* of the upper roll chock 6.

Then, the first inner frame 30 is allowed to descend to the lowermost position, to be brought into the state in FIG. 6 where the positioning of the upper and lower roll chock 6, 5 in the horizontal direction can be released. In this state, the upper roll chock 6 is mounted on the side roll yokes 7, 8 by inserting the pins on the upper faces of the side roll yokes 7, 8 into the pin holes in the leg portions 6*b* of the upper roll chock 6, and the side roll yokes 7, 8 are mounted on the lower roll chock 5 by inserting the pins on the lower faces of the side roll yokes 7, 8 into the pin holes on the upper face of the lower roll chock 5. Thereafter, the lower roll chock 5 is placed on the transfer rail 3, and thus, the stack body 3 is formed.

INDUSTRIAL APPLICABILITY

As apparent from the embodiments, the Turk's head stand according to the invention is so constructed that the stack body of the roll chocks and yokes can be formed and disassembled along with the vertical movements of the inner frames. Similarly, the side rolls can be positioned by being engaged with the inner frames and fixed through the connections and positional adjustments with the jacks. There is no necessity of providing other actuators such as a hydraulic cylinder for forming or disassembling the stack body and for positioning the roll chocks and yokes, except the actuators for moving the inner frames up and down, and therefore, The Turk's head stand has an extremely simple structure.

Moreover, on occasion of exchanging the rolls, it is possible to exchange the rolls by transferring only the stack body of the roll chocks and yokes. The stack body can be formed or disassembled only by operating the inner frames to ascend or descend, and control mechanisms and operations for the actuators are not required in forming the stack body, and therefore, it is possible to exchange the rolls by extremely simple operation.

The invention claimed is:

1. A Turk's head stand comprising:

a first inner frame, including a pair of plates, and incorporated in an outer frame so as to move only in a vertical direction;

a second inner frame, including a pair of plates, and incorporated in the first inner frame so as to move only in a horizontal direction with respect to the first inner frame;

upper and lower roll chocks and right and left side roll yokes, locked in the second inner frame so as to be separated from the second inner frame by a mechanical structure;

position adjusting devices, connected to the respective roll chocks and yokes locked in the second inner frame for moving the upper and lower roll chocks and right and left side roll yokes close to or apart from each other, the position adjusting devices of the upper roll chock, the right side roll yoke and the left side roll yoke being installed between ends of the plates of the second inner frame; and a transfer rail, provided in a lower part of the outer frame in a horizontal direction perpendicular to a product proceeding direction, wherein the whole second inner frame is configured to be transferred in the horizontal direction from an inside of the first inner frame to the transfer rail.

2. The Turk's head stand according to claim 1, wherein the mechanical structure is formed by engagements between strip members which are provided on inner faces of the plates of the second inner frame and on the upper and lower roll chocks and right and left side roll yokes, and grooves which are formed between the strip members.

3. A Turk's head stand comprising:

a first inner frame, including a pair of plates, and incorporated in an outer frame so as to move only in a vertical direction;

a second inner frame including a pair of plates, and incorporated in the first inner frame so as to move only in a horizontal direction with respect to the first inner frame;

upper and lower roll chocks and right and left side roll yokes, locked in the second inner frame so as to be separated from by the second inner frame by a mechanical structure;

position adjusting devices, connected to the respective roll chocks and yokes locked in the second inner frame for moving the upper and lower roll chocks and right and left side roll yokes close to or apart from each other, the position adjusting devices of the upper roll chock, the right side roll yoke and the left side roll yoke being installed between ends of the plates of the second inner frame, one of the position adjusting devices which are installed on a horizontal end being disposed in the second inner frame so as to move in the vertical direction; and a transfer rail, provided in a lower part inside the outer frame in a horizontal direction perpendicular to a product proceeding direction, wherein the respective roll chocks and yokes are locked to desired positions inside the second inner frame by the mechanical structure when the first inner frame ascends, wherein a lock of the respective roll chocks and yokes that lock the roll chocks and yokes at the desired positions is released when the first inner frame descends, so that a stack body of the roll chocks and yokes is formed on the transfer rail, by mounting the right and left side roll yokes on the lower horizontal roll chock, and further mounting the upper horizontal roll chock on the right and left side roll yokes, thereby enabling the stack body to be withdrawn in a direction toward the transfer rail separate from the second inner frame.

4. The Turk's head stand according to claim 3, wherein the mechanical structures is formed by engagements between strip members which are provided on inner faces of the second inner frame and on the upper and lower roll chocks and right and left side roll yokes, and grooves which are formed between the strip members.

* * * * *